US006637363B2

(12) United States Patent
Schmitt et al.

(10) Patent No.: US 6,637,363 B2
(45) Date of Patent: Oct. 28, 2003

(54) ADJUSTABLE BOAT WINDSHIELD SUPPORT BRACE

(76) Inventors: Ronald T. Schmitt, 1015 Woodridge Blvd., Lancaster, PA (US) 17601; Albert H. Bender, Jr., 905 Maple St., Lebanon, PA (US) 17046

( * ) Notice: Subject to any disclaimer, the term of this patent is extended or adjusted under 35 U.S.C. 154(b) by 93 days.

(21) Appl. No.: 09/973,982

(22) Filed: Oct. 10, 2001

(65) Prior Publication Data

US 2002/0046691 A1 Apr. 25, 2002

Related U.S. Application Data

(60) Provisional application No. 60/239,715, filed on Oct. 12, 2000.

(51) Int. Cl.[7] ..... B63B 17/00

(52) U.S. Cl. ..... 114/361; 114/364; 114/343; 248/200.1; 248/354.3

(58) Field of Search ..... 114/343, 361, 114/362, 364, 221 R; 248/200.1, 261, 264, 351, 352, 354.1, 354.3, 354.6; 296/84.1, 96.21, 188; 403/43, 109.1, 109.4, 165, 361

(56) References Cited

U.S. PATENT DOCUMENTS

| | | | | | |
|---|---|---|---|---|---|
| 891,897 | A | * | 6/1908 | Astrom | 254/101 |
| 2,532,168 | A | * | 11/1950 | Jakoubek | 254/101 |
| 2,725,210 | A | * | 11/1955 | Swartz | 248/354.3 |
| 2,832,559 | A | * | 4/1958 | Hillberg | 254/100 |
| 3,131,902 | A | * | 5/1964 | Zak, Jr. | 248/354.3 |
| 3,320,698 | A | * | 5/1967 | Hummel | 49/340 |
| 3,347,543 | A | * | 10/1967 | Zak | 269/296 |
| 3,829,153 | A | * | 8/1974 | Fussell et al. | 296/90 |
| 4,304,078 | A | * | 12/1981 | Meriwether, Jr. | 52/127.2 |
| 4,737,056 | A | * | 4/1988 | Hunt | 410/151 |
| 4,872,634 | A | * | 10/1989 | Gillaspy et al. | 248/354.3 |
| 5,538,364 | A | * | 7/1996 | Huntsman | 405/288 |
| 5,588,694 | A | * | 12/1996 | Koehr | 296/188 |

* cited by examiner

*Primary Examiner*—S. Joseph Morano
*Assistant Examiner*—Ajay Vasudeva
(74) *Attorney, Agent, or Firm*—Miller Law Group, PLLC

(57) ABSTRACT

An adjustable windshield brace for boat windshields has sufficient flexibility to permit utilization on the windshields of many boat manufacturers. The brace is formed of two linearly extending members, one of which is provided with a bell to receive the other member. The belled brace member is formed with internal threading to be engageable with corresponding threads on the other brace member. The threads are finely formed to permit a linear translational movement of approximately one-sixteenth of an inch for each revolution of the brace members. Each brace member is provided with a mounting flange pivotally mounted on the respective opposing ends of the brace members to provide an attitude adjustment of the mounting flanges. Length adjustment and orientation adjustment of one mounting flange relative to the other mounting flange is accomplished by rotating the threads interengaging the two brace members. This three dimensional adjustment of the windshield brace permits the windshield brace to be adapted to many different windshield configurations. The belled portion on the one brace member hides the threads of the other brace member as the windshield brace is extended in length.

18 Claims, 6 Drawing Sheets

Fig. 8
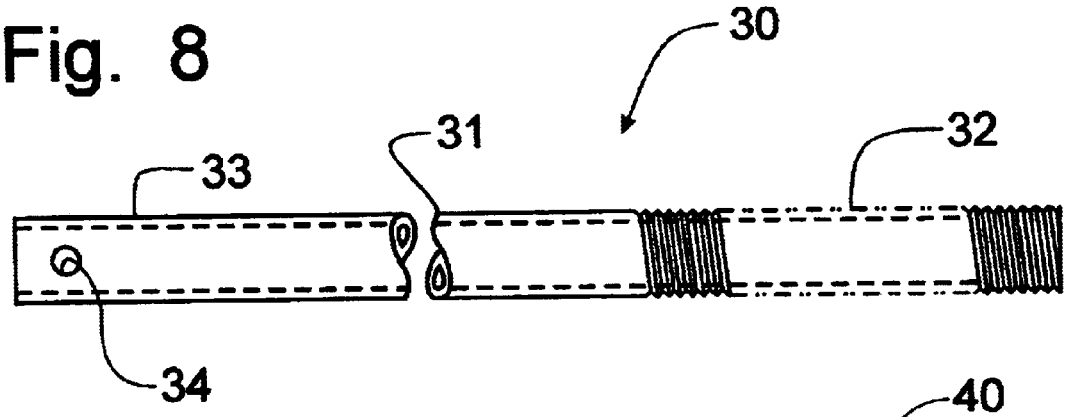
Fig. 9
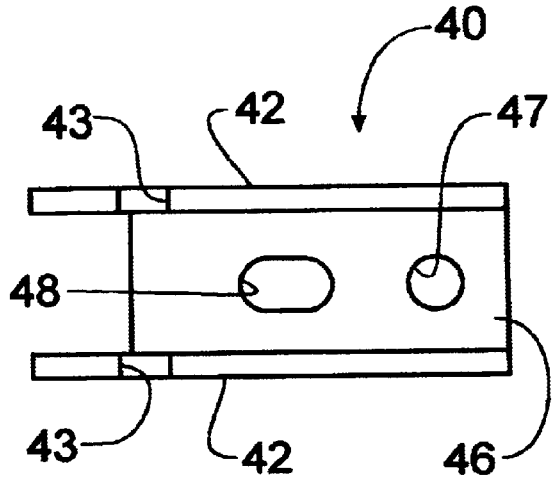
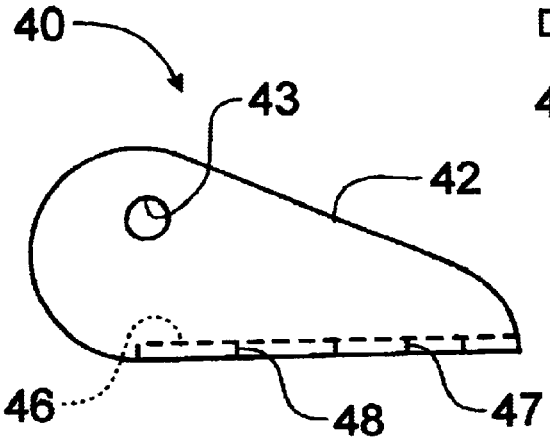
Fig. 10
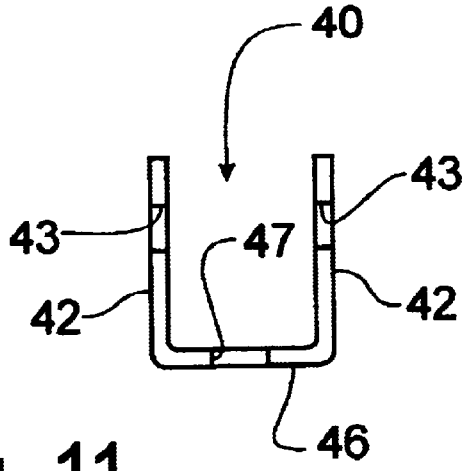
Fig. 11

ADJUSTABLE BOAT WINDSHIELD SUPPORT BRACE

CROSS-REFERENCE TO RELATED APPLICATIONS

This application claims priority on Provisional patent application Ser. No. 60/239,715, filed Oct. 12, 2000, the contents of which are hereby incorporated by reference.

BACKGROUND OF THE INVENTION

This invention relates generally to the marine boating arts and, more particularly, to a brace for supporting a boat windshield to provide stability thereto.

Open-top boats, such as cruisers and bowriders, are typically provided with a windshield projecting upwardly from the body of the boat forwardly of the operator's station to deflect the wind as the boat is moving across the surface of the water. Since there is no permanent or fixed roof structure above the windshield, the windshield projects upwardly in a cantilevered manner. Also, typically, the windshields slant rearwardly toward the operator to decrease wind resistance and to add to the aesthetics of the boat. In boat designs often referred to as a bowrider, the compartment forwardly of the operator's station is open for passenger seating. Access to this forward seating compartment is typically through an opening in the center of the boat, requiring the windshield to have a hinged component that can fold back to open the passageway to the forward compartment.

The typical cantilevered boat windshield is formed with a frame member extending around the perimeter of the windshield to support the glass or plexiglass forming the transparent portion of the windshield. To support the rearwardly slanting, upwardly cantilevered windshield, a brace member is provided to connect to the frame and to connect to the body of the boat, thereby preventing the windshield from deflecting rearwardly from both wind and human forces exerted thereon. For the bowrider-type of boats and others, these braces are typically positioned on opposing lateral sides of the passageway to the forward seating compartment and elsewhere along the length of the windshield to provide support for the windshield. Such placement of the braces allows the hinged portion of the windshield to be opened without reducing the support required for this style or type of windshield. Other non-opening styles of windshields also require support and the braces can be positioned behind the windshield to support the brace adequately to resist the forces exerted thereon.

Conventional boat windshield braces are formed from a fixed length of rod, typically aluminum or steel tubing, with pivoted connecting brackets mounted on the opposing ends of the rod to connect to the windshield frame and the boat body, respectively. The connecting brackets are generally formed with a pivot joint next to the rod so that the mounting bracket can be pivoted into a configuration for proper mounting to the windshield frame or boat body. Some braces are formed for the specific application and style of boat onto which the brace is to be used, and do not have pivoting ends to facilitate the fastening of the brace to the windshield or the support therefor. Most windshield braces are detachable to permit replacement when damaged.

One problem encountered with conventional boat windshield braces is the lack of versatility. While the connecting brackets have a degree of movement about the hinge or pivot point, the connecting brackets are not movable in all three dimensions. Furthermore, the placement of the braces is limited due to the fixed length of the rod, which requires a certain positioning in order to effect a proper fit for the brace. Lastly, these braces do not have a sufficient amount of flexibility to enable the connecting brackets to be oriented in a sharply angled configuration. It would, therefore, be desirable to provide an improved boat windshield brace that would provide a greater amount of flexibility in use and in installation.

SUMMARY OF THE INVENTION

It is an object of this invention to overcome the aforementioned disadvantages of the prior art by providing a windshield brace for a boat that is adjustable in three dimensions.

It is another object of this invention to provide a windshield brace for a boat that is adjustable in length, adjustable in rotation, and adjustable in attitude of the mounting flanges.

It is a feature of this invention that the boat windshield brace is formed as two mating members that are engaged with one another along a major axis thereof by screw threads.

It is another advantage of this invention that the screw threads are finely formed to minimize lateral translation with the rotation of the threads.

It is an advantage of this invention that a single revolution of a first member relative to the other results in a translation of the first member of only approximately one-sixteenth of an inch.

It is another feature of this invention that the rotation of a first member relative to the other results in an orientational adjustment of the mounting flange on the first member to permit the mounting flange to be adjusted for proper orientation for the connecting of the mounting flange to the desired support structure.

It is another object of this invention to provide a windshield brace for a boat in which the brace has sufficient flexibility to permit utilization thereof in substantially all boat windshield installations.

It is still another advantage of this invention that the mounting flanges are pivotally adjustable about the respective pivotal mounting thereof to the brace members to permit an attitude adjustment of each mounting flange independently of the other mounting flange irrespective of the orientation of the mounting flanges.

It is yet another object of this invention to provide an adjustable windshield brace for boats which is durable in construction, inexpensive of manufacture, carefree of maintenance, facile in assemblage, and simple and effective in use.

These and other objects, features and advantages are accomplished according to the instant invention by providing an adjustable windshield brace for boat windshields having sufficient flexibility to permit utilization on the windshields of many boat manufacturers. The brace is formed of two linearly extending members, one of which is provided with a bell to receive the other member. The belled brace member is formed with internal threading to be engageable with corresponding threads on the other brace member. The threads are finely formed to permit a linear translational movement of approximately one-sixteenth of an inch for each revolution of the brace members. Each brace member is provided with a mounting flange pivotally mounted on the respective opposing ends of the brace members to provide an attitude adjustment of the mounting flanges. Length adjustment and orientation adjustment of one mounting flange relative to the other mounting flange is accomplished by rotating the threads interengaging the two brace members. This three dimensional adjustment of the windshield brace permits the windshield brace to be adapted to many different windshield configurations. The belled portion on the one brace member hides the threads of the other brace member as the windshield brace is extended in length.

BRIEF DESCRIPTION OF THE DRAWINGS

The advantages of this invention will become apparent upon consideration of the following detailed disclosure of the invention, especially when taken in conjunction with the accompanying drawings wherein:

FIG. 8 is an elevational view of the bottom brace member corresponding to the orientation of the adjustable brace shown in FIG. 2;

FIG. 9 is a plan view of the connecting bracket;

FIG. 10 is a side elevational view of the connecting bracket taken orthogonally of FIG. 9;

FIG. 11 is an end view of the connecting bracket corresponding to the end of the connecting bracket as depicted in FIG. 10;

DETAILED DESCRIPTION OF THE PREFERRED EMBODIMENT

Figure 1:
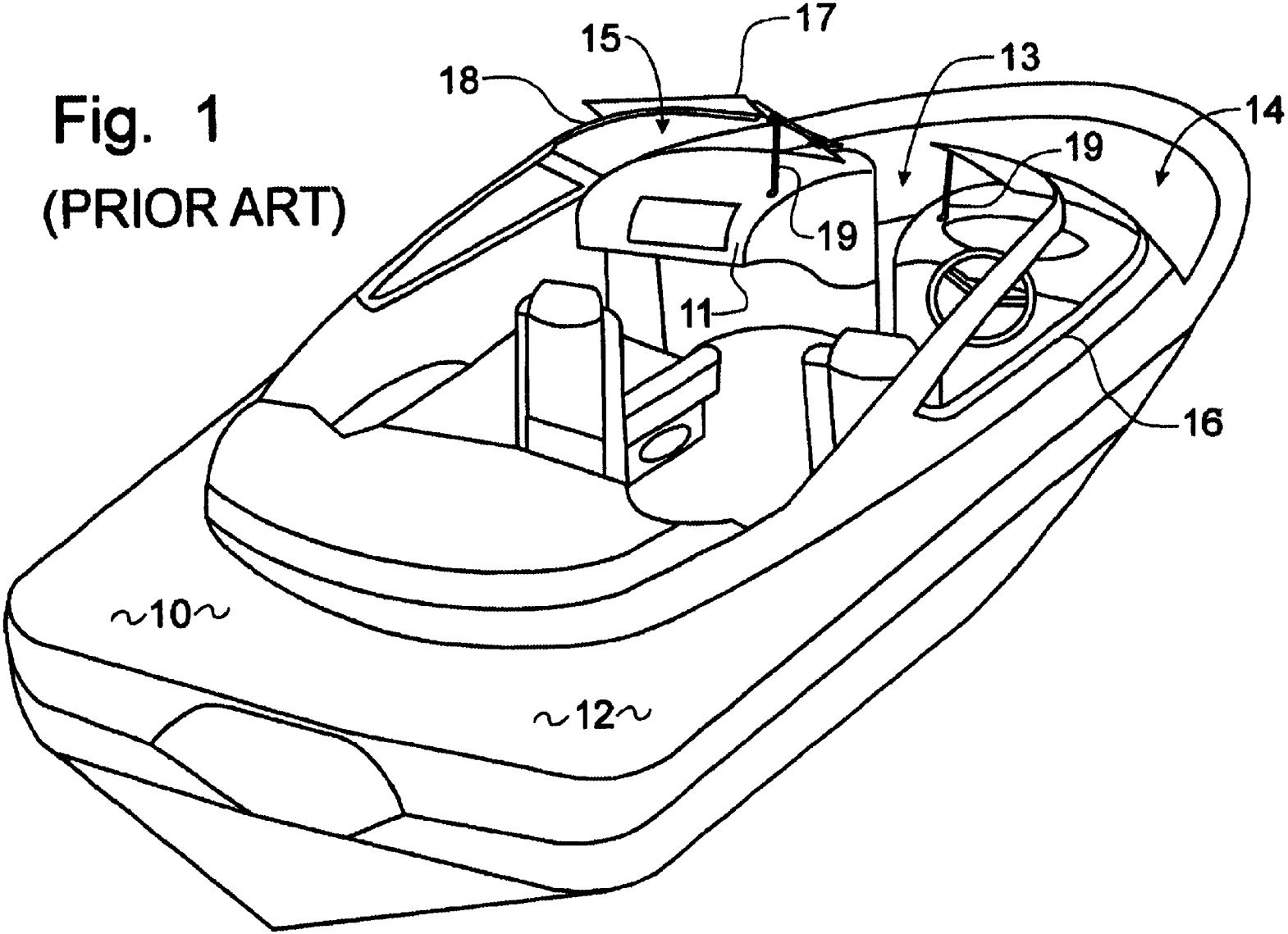
Fig. 1 (PRIOR ART)
FIG. 1 is a schematic perspective view of a bowrider-style of boat having a windshield supported by a conventional windshield brace, the windshield being of the type that has a hinged portion that can open to permit passage to the forward portion of the boat.

Referring now to FIG. 1, a bowrider-style of boat 10 having an upwardly cantilevered windshield 15 utilizing a prior art brace 19 can be seen. While the description below often refers to the bowrider-type of boat, braces 19 are also required for non-opening windshield structures to resist the forces exerted by the wind and by human engagement. The windshield 15 is mounted along the lower edge to the body 12 of the boat 10 and extends upwardly therefrom. Along the transversely extending portion 16 of the windshield 15, a hinged portion 17 is mounted for pivotal movement to open a passageway 13 to permit access to a forward seating compartment 14. Along the central transverse portion 16 of the windshield 15, the windshield 15 slopes upwardly and rearwardly to deflect the wind in an aesthetically pleasing manner. To support the rearwardly sloping central transverse portion 16 of the windshield 15, a brace 19 is located on opposing sides of the passageway 13. Each brace 19 is attached to the body 12 of the boat 10 along the control panel 11 and to the frame 18 extending around the edge of the windshield 15. Typically, the mounting flanges of the brace 19 are screwed to the body 12/frame 18 to permit the brace 19 to be replaceable.

Figure 7:
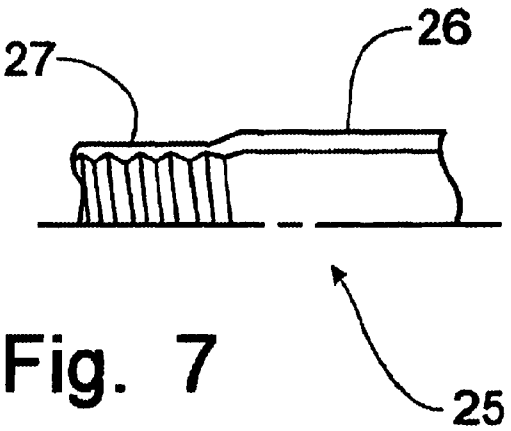
FIG. 7 is an enlarged detail view of a portion of the top brace member where the belled portion joins with the internally threaded portion.
Figure 6:
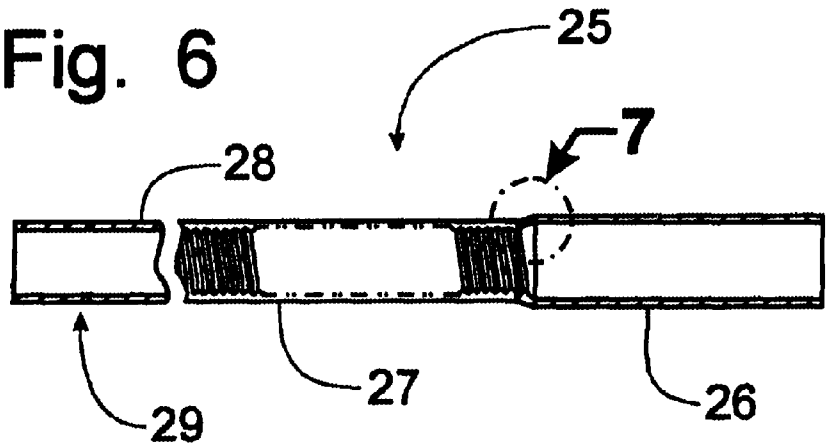
FIG. 6 is a cross-sectional view of the top brace member corresponding to lines 6—6 of FIG. 5.

Referring now to FIGS. 2–4 and 13, the adjustable brace 20 incorporating the principles of the instant invention can best be seen. The adjustable brace 20 is intended to be a replacement for the prior art brace 19, shown in FIG. 1, and be operable to support the central transverse portion 16 of the windshield 15. The adjustable brace 20 includes a central body portion 22 formed as two mating members 25, 30. As can be seen in FIGS. 5–7, the upper member 25 is formed with a belled portion 26 integral with an internally threaded tube portion 27. At the distal end 28 of the tube portion 27, a hole 29 is formed through the tube portion 27 for the connection of a first mounting flange 40, preferably through the use of a detachable fastener 37 or, in the alternative, a rivet or other suitable connector. One skilled in the art will recognize that the internally threaded tube portion 27 could be formed as a nut (not shown) or other threaded member welded internally of the upper member 25 to provide the threaded engagement with the rod portion 32 to permit the translational adjustment movement described below.

Referring now to FIGS. 2–4 and 8, the lower member 30 of the adjustable brace 20 is a rod member 31 having a hole 34 through the distal end 33 for connecting a second mounting flange 45 in the same preferred manner as the first mounting flange 40. One skilled in the art will recognize that the rod member 31 could be fabricated as a hollow tube having threads formed on the outer surface thereof, as well as a solid rod member. The rod member 31 is threaded on the outer circumference 32 so as to be threadably engaged with the internal threads of the upper member 25. One skilled in the art will recognize that the use of the terms of "upper" and "lower" is a matter of convenience in the description of the two mating members 25, 30, as the adjustable brace 20 can be utilized in substantially any orientation or configuration as will be described in greater detail below.

Figure 12:
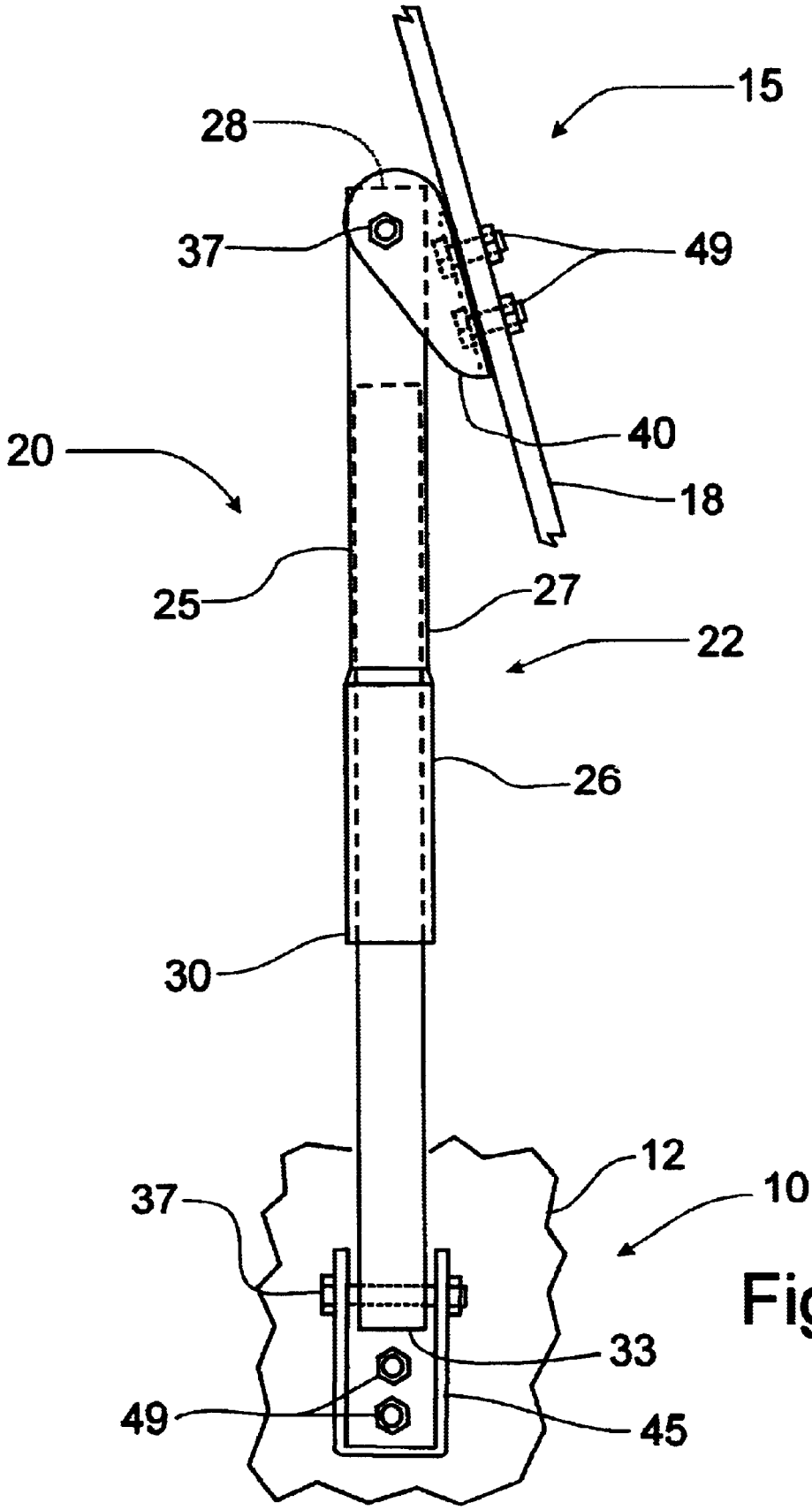
FIG. 12 is an enlarged elevational view of the adjustable boat windshield brace depicting the versatility of the adjustable brace in adapting to differently oriented mounting surfaces and a tight windshield mounting connection.
Figure 13:
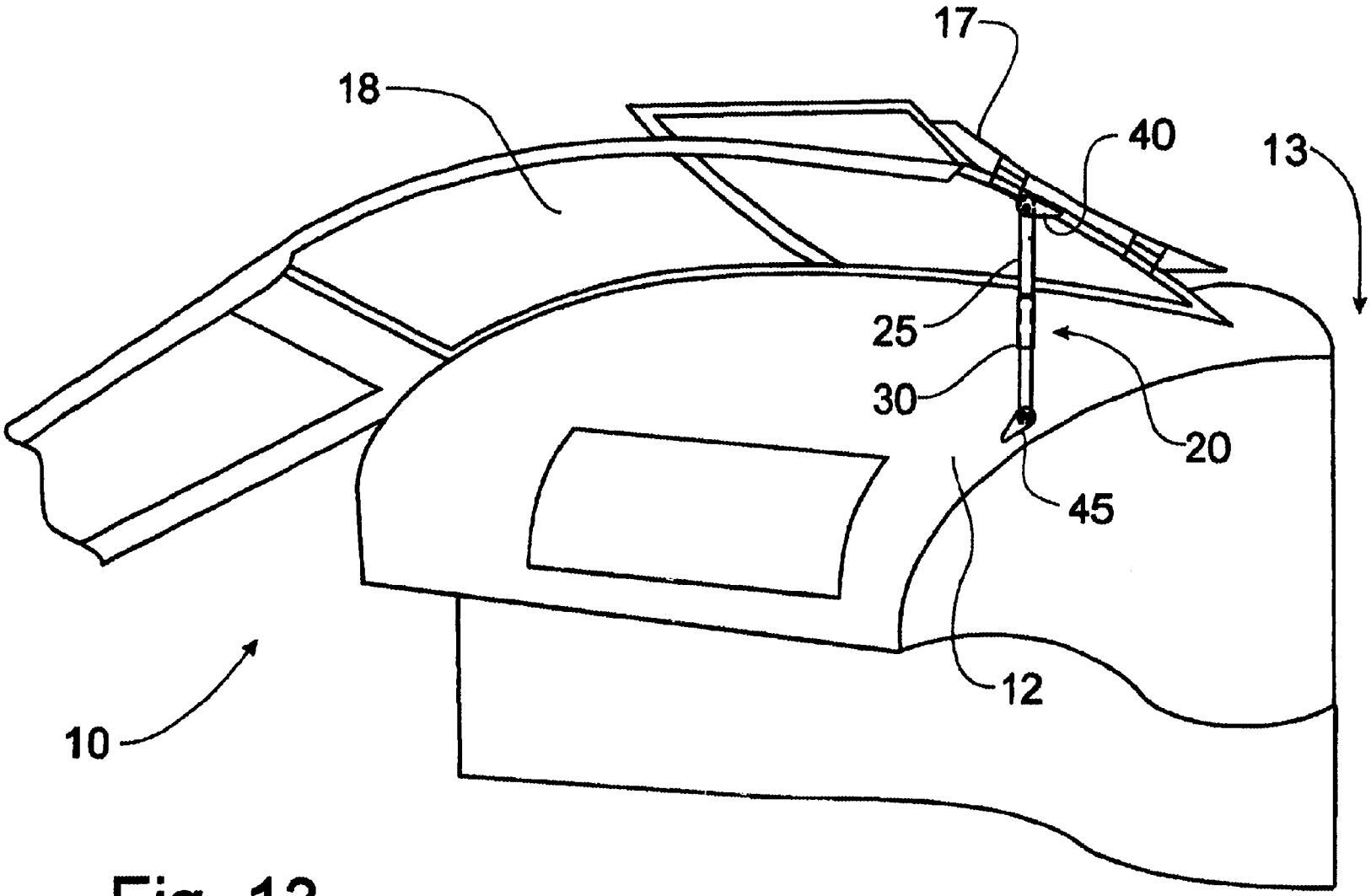
FIG. 13 is schematic partial right rear perspective view of a boat windshield supported by an adjustable support brace incorporating the principles of the instant invention.

The mounting flanges 40, 45 can best be seen in FIGS. 2–4 and FIGS. 9–11. The first and second mounting flanges 40, 45 are identical in construction and are designed to permit utilization of the adjustable brace 20 as a replacement for existing prior art braces 19, as well as in new boat construction. Each mounting flange 40, 45 is formed as a U-shaped stamping with a pair of opposing upright arms 42 integral with a bight portion 46. The upright arms 42 are provided with an opening 44 therethrough for the passage of the fastener 37 in the mounting of the flange 40, 45 to the respective mating members 25, 30. The bight portion 46 is formed with a pair of openings 47, 48 for the passage of screws or bolts 49 (as depicted in FIG. 12) to connect the mounting flanges 40, 45 to the members to which the adjustable brace 20 is to be attached. One of the openings 47 is preferably formed as a circular opening, while the second of the openings 48 is preferably formed as a slot to provide some flexibility in hole spacing when the adjustable brace 20 is being used to replace an existing prior art brace 19.

Returning now to FIGS. 5–7, the upper member 25 is formed from a piece of tubing stock that is first placed on a mandrel to form the belled portion 26 to allow for the passage of the lower member 30 when assembled. The upper member 25 is then threaded internally at the tube portion 27 immediately adjacent to the belled portion 26. The hole 29 is also drilled into the distal end 28 of the tube portion 27. As is noted in FIG. 7, the belled portion 26 is preferably formed to enlarge outwardly from the tube portion 27 at an angle of approximately 15 degrees until the inside diameter of the belled portion 26 is slightly greater than the outside diameter of the lower member 30. An annular plastic shim (not shown) may be necessary between the mated belled portion 26 of the upper member 25 and the lower member 30 to prevent the exterior surface of the lower member 30 from being marked by interference between the interior of the belled portion 26 and the lower member 30. The belled portion 26 of the upper member 25 has a sufficient length as to aesthetically hide the threads of the lower member 30 whenever the brace is adjusted to its maximum effective length, so that no threads are exposed whether the brace 20 is manipulated to be at its maximum length or its minimum length. Furthermore, the upper portion 25 may have a protective coating applied to the interior of the belled portion 26 to avoid scratching or marking the preferably polished outer surface of the lower tube 30 when the two members 25, 30 are rotated to adjust the effective length of the brace 10. This protective coating could be Teflon or other suitable material.

As can be seen in FIG. 8, the lower member 30 is preferably formed from tubular stock and is threaded on the outer surface 32 at one end of the lower member 30 for a distance to correspond to the length of the threads placed internally of the rod portion 27 of the upper member 25. Preferably, the length of the respective threads will provide approximately two inches of translational movement between the upper and lower members 25, 30 while still providing a functional bracing member in operation. The distal end 33 of the lower member 30 is drilled to form the hole 34 for the mounting of the second mounting flange 45. Preferably, an indicator (not shown), such as a marking on the lower member 30 that will become exposed beyond the belled portion 26, will indicate when the brace 20 has reached its maximum effective length of operation.

Figure 3:
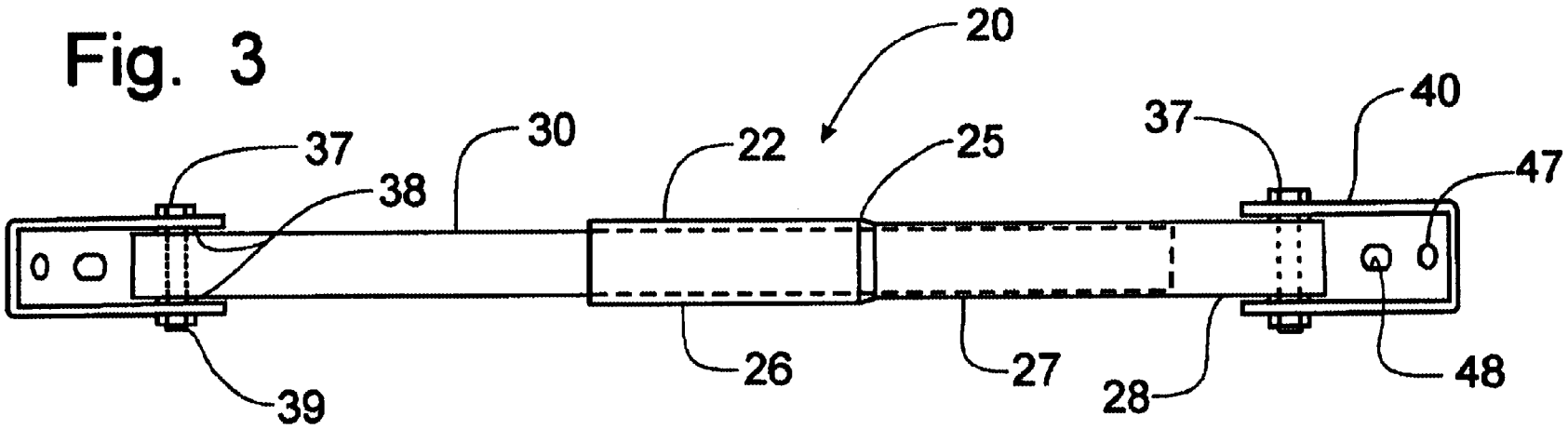
FIG. 3 is an elevational view of the adjustable brace shown in FIG. 2 but taken from an orthogonal viewpoint so that the connecting brackets are now seen in substantial plan view.
Figure 2:
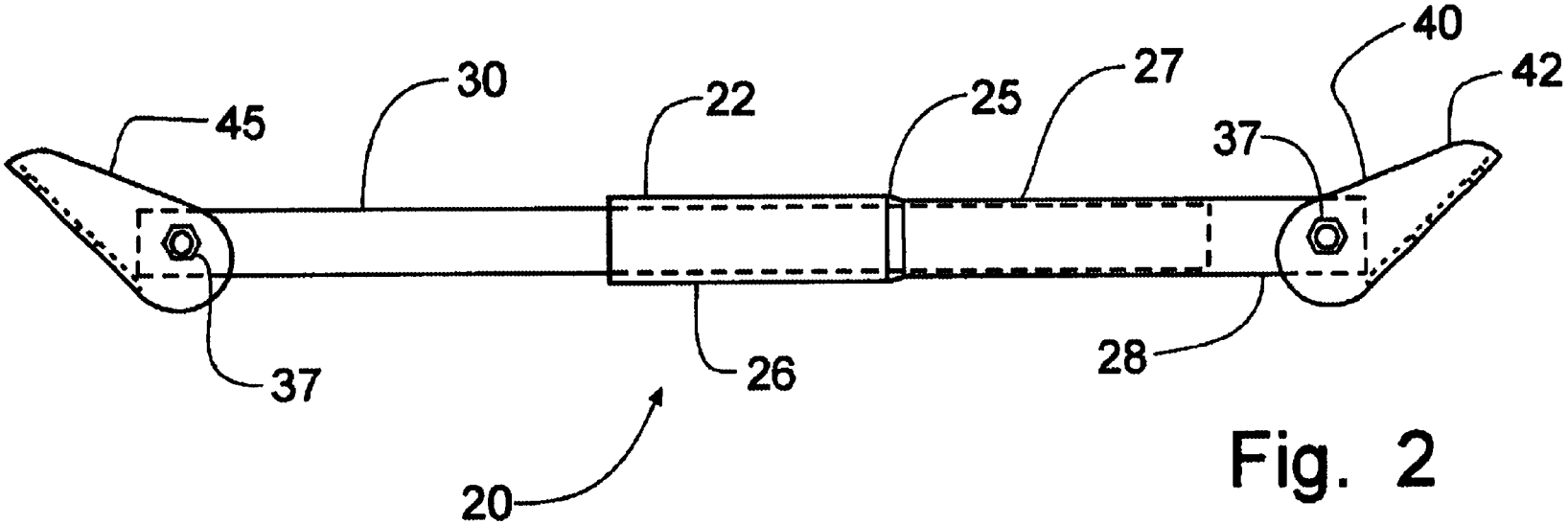
FIG. 2 is an elevational view of the adjustable brace incorporating the principles of the instant invention, the elevational view depicting the connecting brackets in side orientation.
Figure 4:
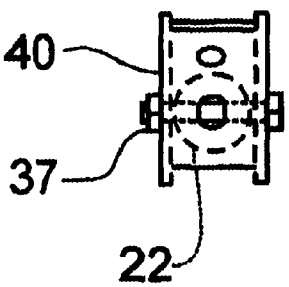
FIG. 4 is an end view of the adjustable boat windshield brace as seen from the end of FIG. 2.
Figure 5:
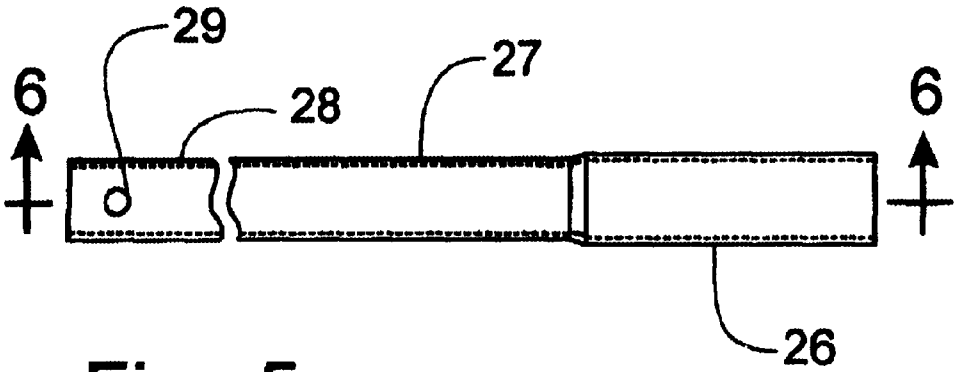
FIG. 5 is an elevational view of the top brace member.

As is best seen in FIGS. 2–4, the assembled components form an adjustable brace 20 whose overall effective length can be adjusted approximately two inches in a manner to be described in greater detail below. The mounting flanges 40, 45 are connected at opposing ends 28, 33 of the brace 20 for connection to the windshield frame and body of the boat as desired. The lower member 30 is threadably engaged with the internal threads of the tube portion 27 of the upper member 25 to allow for a rotational manipulation therebetween to change the effective length of the brace 20.

The mounting flanges 40, 45 are pivotally attached by the fasteners 37 to the respective distal ends 28, 33 to allow the brace 20 to be connected to a surface irrespective of the angular disposition or configuration that surface might have. One skilled in the art will understand that spacers or washers 38 will be desired between mounting flange 40, 45 and the adjacent surfaces of the respective distal ends 28, 33 to facilitate pivotal movement between the mounting flange 40, 45 and the corresponding distal end 28, 33. A locking nut 39 is preferably used with the detachable fasteners 37 to securely fasten the mounting flanges 40, 45 in the selected pivoted position.

As best seen in FIG. 12, the adjustable brace 20 is capable of positional adjustment throughout 360 degrees of rotational movement. Not only can the two mating members 25, 30 be rotationally manipulated to adjust the length of the brace 20, but a single rotation of the respective members 25, 30 can effect an adjustment of the orientation of the mounting flange 40, 45 at either distal end 28, 33. As is unknown in the prior art braces 19, the adjustable brace 20 can be manipulated to orient the mounting flanges 40, 45 at different operative planes. As is depicted in FIG. 12, the second mounting flange 45 on the lower member 30 (which is shown as being connected to the body 12 of the boat 10) could be oriented in one plane to mount the brace 20 to a correspondingly oriented surface of the body 12, while the first flange 40 on the upper member 25 is oriented in a different plane to attach the brace 20 to the frame 18 around the windshield 15. By forming the threads in the upper member 25 and on the lower member 30 with a thread spacing of at least 18 threads per inch, a single rotation of the two mating members 25, 30 would cause less than a sixteenth of an inch of translational movement effecting a change in the overall length of the brace 20.

Furthermore, the use of detachable fasteners 37 to attach the mounting flanges 40, 45 to the distal ends 28, 33 of the brace 20 allows a different mounting technique heretofore unknown with prior art braces 19. In some mounting installations, the rake angle of the member 18 to which the mounting flange 40, 45 is to be connected is so severe and spacial limitations are such that there is little room for the insertion of the screws or bolts 49 connecting the mounting flange 40, 45 to the member 18 or the body 12, for example. With the adjustable flange having a detachable fastener 37, the mounting flange 45 could be connected to the body member 18 first and then the body portion 22 of the brace 20 can be connected to the affixed mounting flange 45 to provide the necessary support for the member 18. Both flanges 40, 45 can be attached to the corresponding mounting surface in this manner with the body portion 22 of the brace 20 being connected to the flanges 40, 45 later.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A brace supporting a boat windshield comprising:

a first linearly extending brace member having external threads formed on one end thereof;

a first mounting flange pivotally mounted on an opposing end of said first brace member about a first pivot axis;

a second linearly extending brace member having internal threads formed in one end thereof to correspond to the external threads formed on said first brace member, said second brace member being adapted to receive said first brace member such that said first and second brace members are threadably engaged and linearly adjustable in length in response to rotation of one of said brace members relative to the other brace member; and a second mounting flange pivotally mounted on an opposing end of said second brace member about a second pivot axis, each said mounting flange being positionally adjustable relative to the other said mounting flange in three attitudes, pivotal movement about the corresponding said pivot axis, linear distance between said respective pivot axes, and rotational orientation.

2. The brace of claim 1 wherein said second brace member is at least partially hollow to permit the receipt of said first brace member.

3. The brace of claim 2 wherein said second brace member is formed with a belled portion at said one end thereof to cover the threads of said first brace member as said first brace member is rotated out of said second brace member to extend the distance between the first and second pivot axes of said mounting flanges.

4. The brace of claim 3 wherein said belled portion is not formed with internal threading to engage with the external threading of said first brace member.

5. The brace of claim 3 wherein said first brace member is formed with a mark to indicate maximum permissible length extension when viewed externally of said belled portion of said second brace member.

6. The brace of claim 5 wherein said mark is said external threading on said first brace member.

7. The brace of claim 3 wherein said mounting flanges are connected to the respective brace members by detachable fasteners forming the respective pivot axes.

8. The brace of claim 7 wherein each said mounting flange is adapted for connection to an external support member, said mounting flanges being attachable to said external support member before being connected to the corresponding brace member.

9. An adjustable brace attached to a boat windshield and to a boat support structure to support said boat windshield relative to said support structure comprising:

a first linearly extending brace member having external threads formed on one end thereof;

a first mounting flange pivotally mounted on an opposing end of said first brace member by a first detachable fastener defining a first pivot axis, said first mounting flange being connected to one of said boat windshield and said boat support structure;

a second linearly extending brace member having internal threads formed in one end thereof to correspond to the external threads formed on said first brace member, said second brace member being adapted to receive said first brace member such that said first and second brace members are threadably engaged and linearly adjustable in length in response to rotation of one of said brace members relative to the other brace member; and a second mounting flange pivotally mounted on an opposing end of said second brace member by a second detachable fastener defining a second pivot axis, said second mounting flange being connected to the other of said boat windshield and said boat support structure opposite of said first mounting flange, each said mounting flange being positionally adjustable relative to the other said mounting flange in three attitudes, pivotal movement about the corresponding said pivot axis, linear distance between said respective pivot axes, and rotational orientation.

10. The brace of claim 9 wherein said second brace member is formed with a bell at said one end thereof to cover the threads of said first brace member as said first brace member is rotated out of said second brace member to extend the distance between the first and second pivot axes of said mounting flanges.

11. The brace of claim 10 wherein said first brace member is provided with a mark indicating maximum permissible length extension when said mark is exposed externally of said bell of said second brace member.

12. The brace of claim 11 wherein said bell is formed without internal threading to engage with the external threading of said first brace member.

13. A method of supporting a boat windshield comprising the steps of:

providing an adjustable brace device formed with two members threadably engaged so that relative rotation therebetween varies a length dimension of said brace device, each opposing end of said brace device having a pivotally attached mounting flange adapted for connection to a support structure;

rotating one of said members of said brace device relative to the other said member until said length dimension corresponds to a desired length distance between a mounting position on said boat windshield and a mounting position on said support structure;

further rotating one of said members of said brace device relative to the other said member until said mounting flanges at each opposing end of said brace device are aligned with said mounting position on said boat windshield and said mounting position on said support structure;

positioning said mounting flanges until said mounting flanges are substantially parallel to the corresponding said mounting positions on said windshield and said support structure; and fastening said mounting flanges to the corresponding said mounting positions on said windshield and said support structure.

14. The method of claim 13 wherein said positioning step includes the steps of:

detaching one of said mounting flanges from the corresponding said member prior to said fastening step; and re-attaching said one mounting flange to said corresponding said member after said fastening step.

15. The method of claim 14 wherein said positioning step further includes the step of:

pivoting the other of said mounting flanges about the connection thereof to the corresponding said member until said mounting flange is oriented for said fastening step.

16. The method of claim 13 wherein said positioning step includes the step of:

pivoting each of said mounting flanges about a pivot axis connecting each respective said mounting flange to the corresponding said member until said mounting flange is oriented for said fastening step.

17. The method of claim 16 wherein said rotating step is limited to a maximum length dimension, said method further comprising the steps of:

exposing a mark on one of said members when said maximum length dimension has been attained by said rotating step; and halting said rotating step to increase said length dimension.

18. The method of claim 17 wherein the other of said members is formed with a bell into which said one member is inserted, said method further comprising the step of:

concealing screw threads formed on said one member within said bell, said exposing step including the step of viewing said mark externally of said bell.

* * * * *